US007832819B2

(12) United States Patent
Richards et al.

(10) Patent No.: US 7,832,819 B2
(45) Date of Patent: Nov. 16, 2010

(54) OPEN LOOP PRINT SPEED CONTROL

(75) Inventors: Austin Lloyd Richards, Wheathampstead (GB); William Bruce Weaver, Sherwood, OR (US); Michael Kenneth Oehl, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 820 days.

(21) Appl. No.: 11/584,124

(22) Filed: Oct. 20, 2006

(65) Prior Publication Data

US 2008/0094430 A1 Apr. 24, 2008

(51) Int. Cl.
*B41J 2/195* (2006.01)

(52) U.S. Cl. ..... 347/7; 347/6; 347/14

(58) Field of Classification Search ..... 347/7
See application file for complete search history.

(56) References Cited

U.S. PATENT DOCUMENTS 6,089,686 A 7/2000 Thornton et al.
6,563,600 B1 * 5/2003 Young ..... 358/1.5
6,789,883 B2 * 9/2004 Heim et al. ..... 347/85
6,897,968 B1 5/2005 Markham
6,981,754 B2 1/2006 Godil et al.
2005/0140705 A1 * 6/2005 Godil et al. ..... 347/7
2008/0088660 A1 * 4/2008 Lowe et al. ..... 347/14

* cited by examiner

*Primary Examiner*—Matthew Luu
*Assistant Examiner*—Brian J Goldberg
(74) *Attorney, Agent, or Firm*—Maginot, Moore & Beck LLP

(57) ABSTRACT

A method for controlling print speed of an imaging device is provided. The imaging device includes at least one reservoir for supplying liquid ink to a print head and a level sensor in the reservoir. The method comprises measuring an image density of at least a portion of a print job for the imaging device. A state of a level sensor in a print head reservoir is detected. The print speed is adjusted to a target speed in response to the level sensor indicating an open loop state. The target speed is a function of the image density. The print speed is adjusted to a default speed in response to the level sensor indicating a closed loop state.

10 Claims, 6 Drawing Sheets

OPEN LOOP PRINT SPEED CONTROL

TECHNICAL FIELD

This disclosure relates generally to phase change ink jet printers, and in particular, to the print head assembly used in such ink jet printers.

BACKGROUND

Solid ink or phase change ink printers conventionally use ink in a solid form, either as pellets or as ink sticks of colored cyan, yellow, magenta and black ink, that are inserted into feed channels through openings to the channels. Each of the openings may be constructed to accept sticks of only one particular configuration. Constructing the feed channel openings in this manner helps reduce the risk of an ink stick having a particular characteristic being inserted into the wrong channel. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al. describe exemplary systems for delivering solid ink sticks into a phase change ink printer.

After the ink sticks are fed into their corresponding feed channels, they are urged by gravity or a mechanical actuator to a heater assembly of the printer. The heater assembly includes a heater that converts electrical energy into heat and a melt plate. The melt plate is typically formed from aluminum or other lightweight material in the shape of a plate or an open sided funnel. The heater is proximate to the melt plate to heat the melt plate to a temperature that melts an ink stick coming into contact with the melt plate. The melt plate may be tilted with respect to the solid ink channel so that as the solid ink impinging on the melt plate changes phase, it is directed to the reservoir for that color. The ink stored in the reservoir continues to be heated while awaiting subsequent use.

Each reservoir of colored, liquid ink may be coupled to a print head through at least one manifold pathway. The liquid ink is pumped from the reservoir to the print head as the print head demands ink for jetting onto a receiving medium or image drum. The print head elements, which are typically piezoelectric devices, receive the liquid ink and expel the ink onto an imaging surface as a controller selectively activates the elements with a driving voltage. Specifically, the liquid ink flows from the reservoirs through manifolds to be ejected from microscopic orifices by piezoelectric elements in the print head.

Ink-jet printing systems commonly utilize either direct printing or offset printing architecture. In a typical direct printing system ink is ejected from jets in the print head directly onto the final receiving medium. In an offset printing system, the print head jets the ink onto an intermediate transfer surface, such as a liquid layer on a drum. The final receiving medium is then brought into contact with the intermediate transfer surface and the ink image is transferred and fused or fixed to the medium.

In some direct and offset printing systems, the print head may move relative to the final receiving medium or the intermediate transfer surface in two dimensions as the print head jets are fired. Typically, the print head is translated along an X-axis while the final receiving medium/intermediate transfer surface is moved along a Y-axis. In this manner, the print head "scans" over the print medium and forms an image by selectively depositing ink drops at specific locations on the medium.

One object of the control strategy is to avoid the printing system, and, in particular, the print head reservoir, running out of ink while trying to print. Prior known systems typically supply a sensor in the reservoir to indicate when the ink levels therein drop below a threshold level. When the ink drops below the threshold, the ink supply control system melts more of the solid ink supply until the reservoir refills to an appropriate supply level. Detecting an ink supply deficiency, melting the solid ink in response to the deficiency, and refilling the reservoir to a supply level with the melted ink is commonly referred to as an "ink melt duty cycle."

One problem that is faced during imaging operations is maintaining an adequate supply of ink in the reservoir. Running a print head reservoir dry can damage the print head mechanism. Even if the print head mechanism is not damaged, the print head may have to be re-primed once the reservoir is refilled or replaced. In addition, maintaining adequate amounts of liquid ink in the print head reservoir may become more difficult as throughput rates for liquid ink print heads increase.

In order to avoid exhaustion of the ink supply in the reservoir, conventional systems typically pause or stop printing when a reservoir sensor indicates that the ink level in the reservoir has reached or passed the threshold level. Printing operations are paused or stopped until the ink level in the reservoir is replenished to at least the threshold level. Thus, during high throughput printing operations, a printer may have frequent and/or intermittent delays to allow the reservoir to be continually replenished thereby causing the printing rate to fall below specifications.

SUMMARY

A method for controlling print speed of an imaging device is provided. The imaging device includes at least one reservoir for supplying liquid ink to a print head and a level sensor in the reservoir. The method comprises detecting a solid area coverage (SAC) value of a page of a print job for the imaging device. A state of a level sensor in a print head reservoir is detected. The print speed is adjusted to a target speed in response to the level sensor indicating an open loop state. The target speed may be function of the SAC value. The print speed is adjusted to a default speed in response to the level sensor indicating a closed loop state.

In another embodiment, a system for controlling print speed of an imaging device comprises a level sensor for generating a signal indicating an open loop state when ink volume in a print head reservoir falls below a setpoint level and a signal indicating a closed loop state when the ink volume returns to the setpoint level. The system includes a pixel counter for determining a solid area coverage (SAC) value for a print job; and a controller in communication with the level sensor and the pixel counter. The controller is configured to adjust the print speed of the imaging device from a default speed to a target speed in response to the signal indicating an open loop state. The target speed corresponds to the SAC value.

In yet another embodiment, a method for controlling print speed of a phase change ink imaging device comprises detecting a solid area coverage (SAC) value of a print job for the imaging device. An estimate is maintained of a volume of ink in the reservoir. A determination is then made if the level sensor indicates that the reservoir is in an open loop state or closed loop state. The estimate of the amount of liquid ink in the reservoir is compared to a threshold value when in the open loop state. If the estimate is less than the threshold value, the print speed is adjusted to a target speed that corresponds to the SAC value. If the estimate is greater than threshold value, the print speed of the imaging device is adjusted to the default speed.

BRIEF DESCRIPTION OF THE DRAWINGS

The foregoing aspects and other features of a fluid transport apparatus and an ink imaging device incorporating a fluid transport apparatus are explained in the following description, taken in connection with the accompanying drawings, wherein.

DETAILED DESCRIPTION

Figure 1:
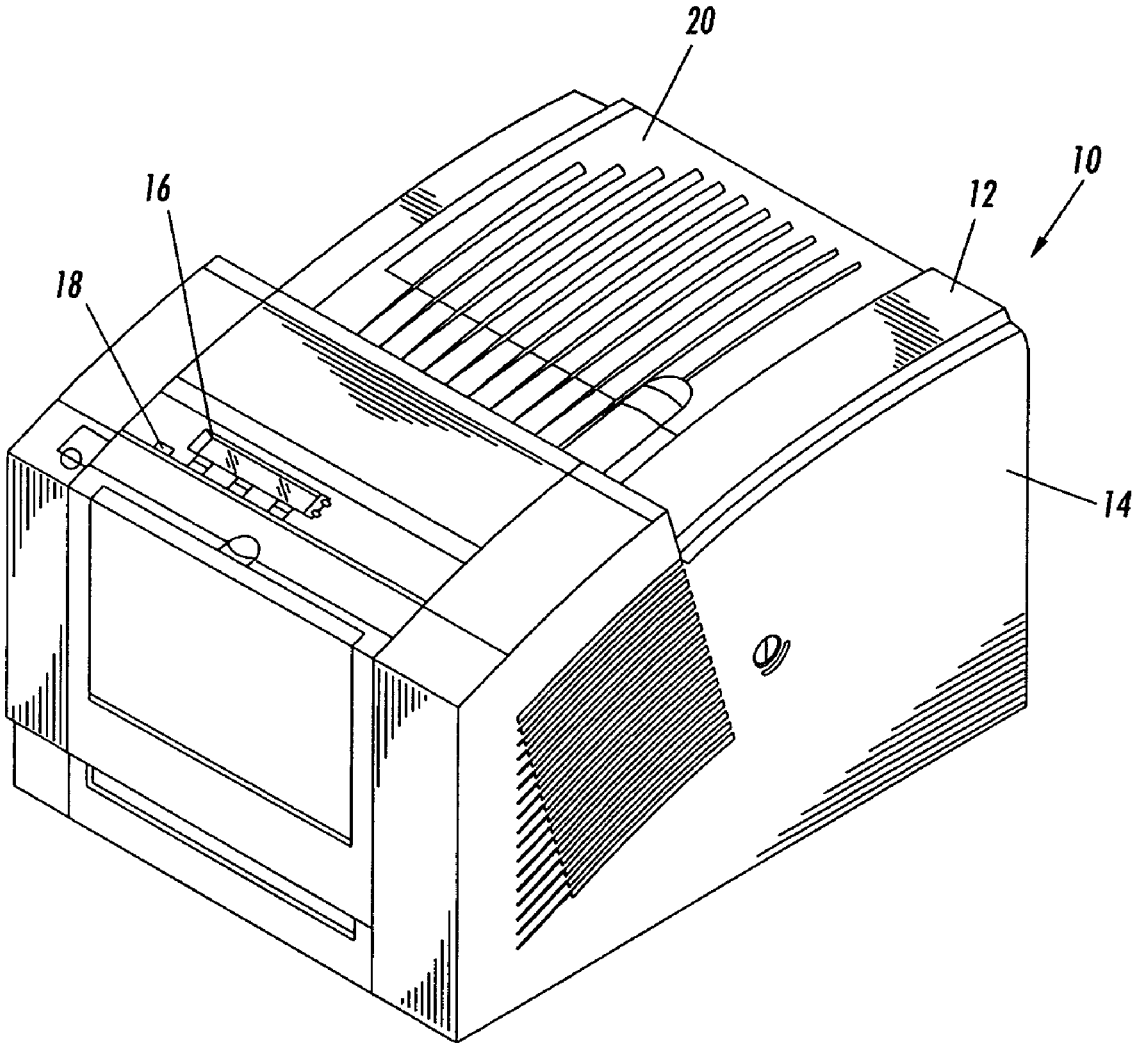
FIG. 1 is a perspective view of a phase change imaging device having a fluid transport apparatus described herein.

For a general understanding of the present embodiments, reference is made to the drawings. In the drawings, like reference numerals have been used throughout to designate like elements.

Referring to FIG. 1, there is shown a perspective view of an ink printer 10 that implements a solid ink offset print process. The reader should understand that the embodiment discussed herein may be implemented in many alternate forms and variations and is not limited to solid ink printers only. The system and process described below may be used in image generating devices that operate components at different temperatures and positions to conserve the consumption of energy by the image generating device. Additionally, the principles embodied in the exemplary system and method described herein may be used in devices that generate images directly onto media sheets. In addition, any suitable size, shape or type of elements or materials may be used.

The ink printer 10 includes an outer housing having a top surface 12 and side surfaces 14. A user interface display, such as a front panel display screen 16, displays information concerning the status of the printer, and user instructions. Buttons 18 or other control mechanisms for controlling operation of the printer are adjacent the user interface window, or may be at other locations on the printer. An ink jet printing mechanism is contained inside the housing. The top surface of the housing includes a hinged ink access cover 20 that opens as shown in FIG. 2, to provide the user access to the ink feed system.

Figure 2:
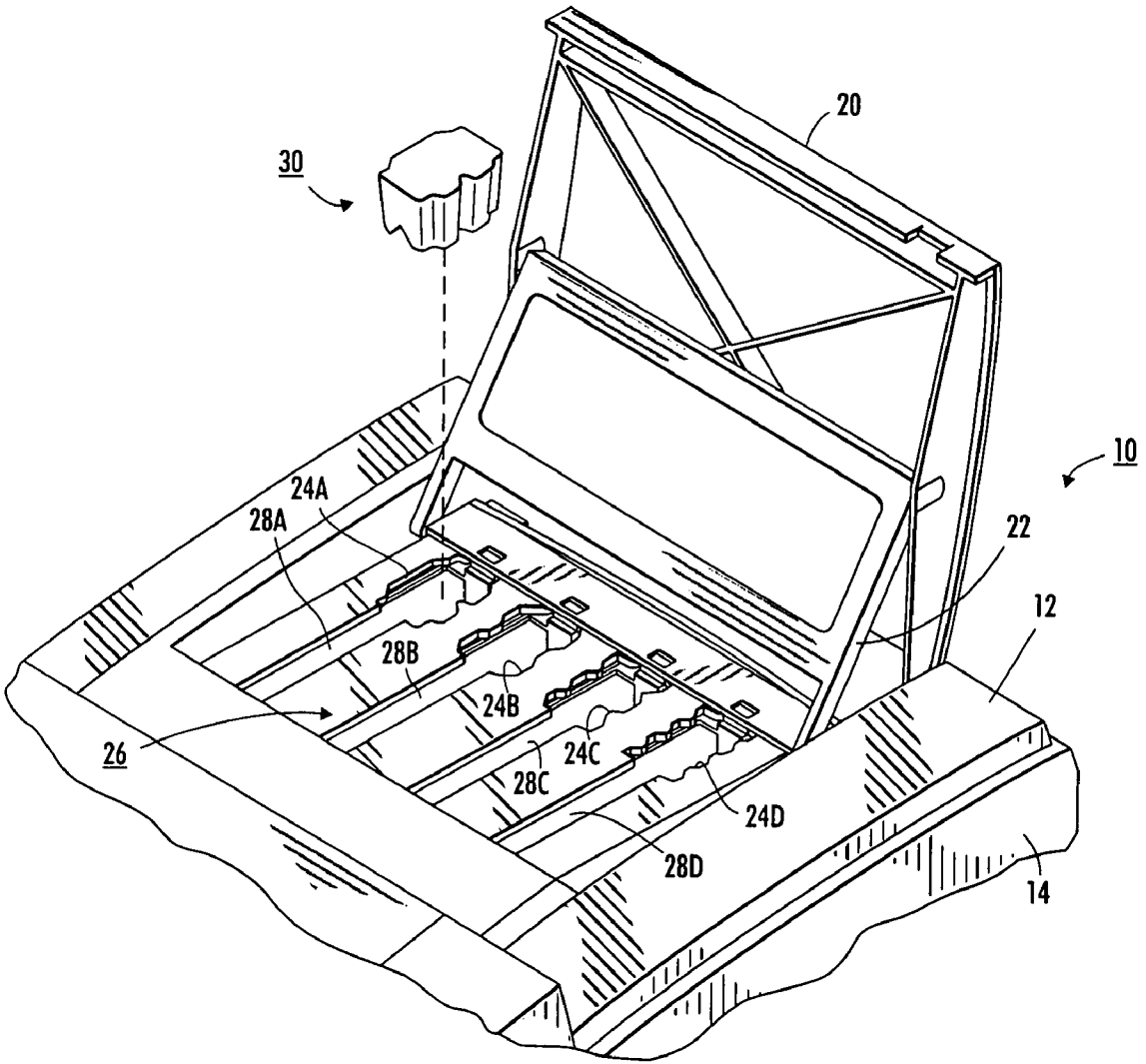
FIG. 2 is an enlarged partial top perspective view of the phase change imaging device of FIG. 1 with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through one of the feed channels 28A-D having the appropriately keyed opening 24A-D that corresponds to the shape of the colored ink stick. The key plate 26 has keyed openings 24A, 24B, 24C, 24D to aid the printer user in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
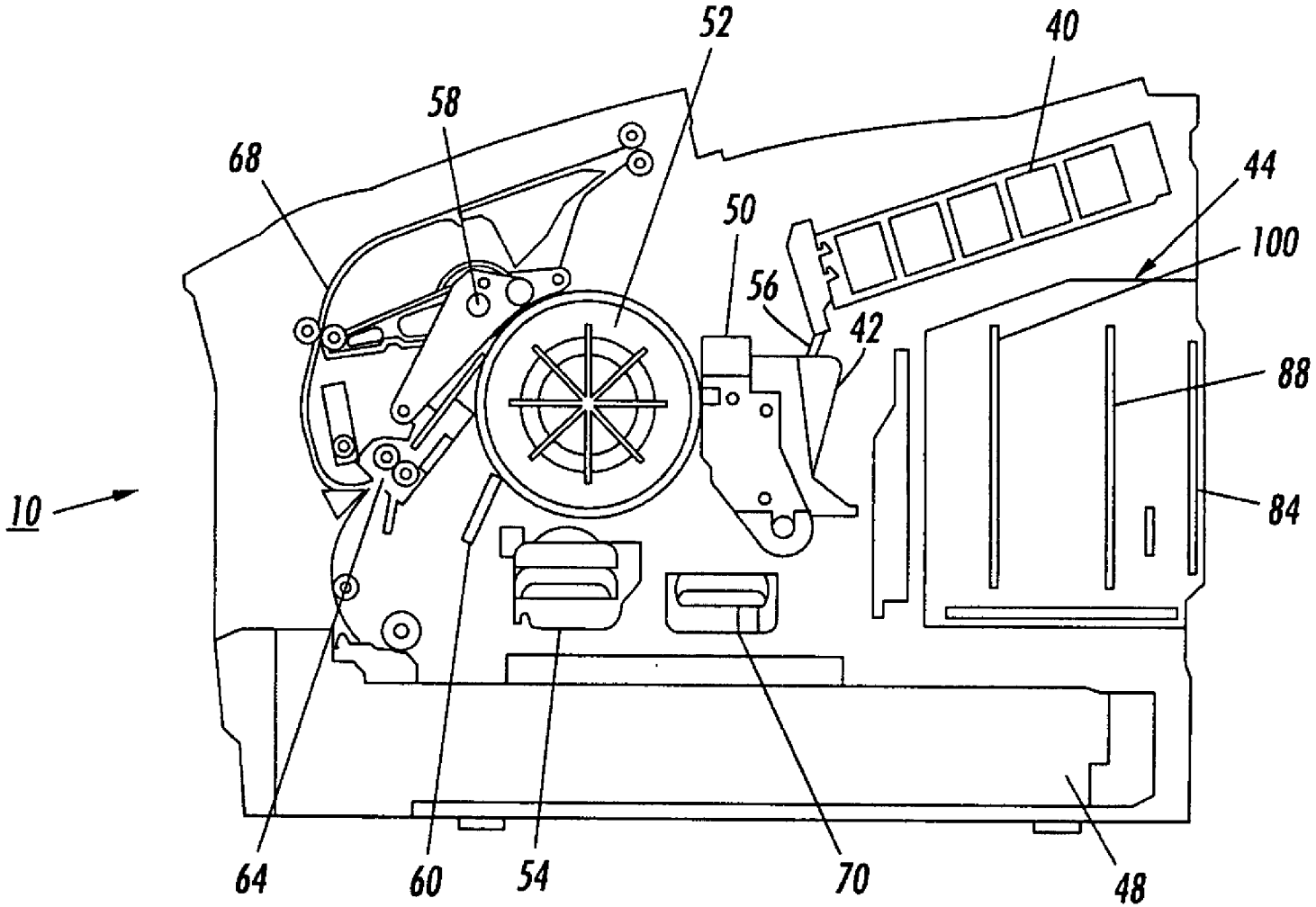
FIG. 3 is a side view of the imaging device shown in FIG. 1 depicting the major subsystems of the ink imaging device.

Referring now to FIG. 3, the ink printer 10 may include an ink loading subsystem 40, an electronics module 44, a paper/media tray 48, a print head assembly 50, an intermediate imaging member 52, a drum maintenance subsystem 54, a transfer subsystem 58, a wiper subassembly 60, a paper/media preheater 64, a duplex print path 68, and an ink waste tray 70. Solid ink sticks are loaded into ink loader feed path 40 through which they travel to a solid ink stick melting assembly 32. The solid ink sticks may be transported by gravity and/or urged by a drive member, such as, for example, a belt or spring, toward a melt plate in the melting assembly 32. At the ink melting assembly 32, the ink stick is melted and the liquid ink is delivered to an ink reservoir 42 through a transport conduit 56. The reservoir 42 is coupled to the print head assembly 50 for jetting the liquid ink onto an ink receiver.

In the illustrated embodiment, the print head assembly 50 is moved parallel to the transfer member 58 as the member is rotated and the print head jets (not shown) are fired. In this manner, an ink image is deposited on the intermediate transfer member. When the image is fully deposited on the intermediate transfer surface, a sheet of recording media is removed from the paper/media tray 48 and directed into the paper pre-heater 64 so the sheet of recording media is heated to a more optimal temperature for receiving the ink image. The medium is then brought into contact with the transfer member 58, and the deposited image is simultaneously transferred and fixed (transfixed) to the medium.

Although the ink receiver has been described as the intermediate imaging member, in another embodiment, such as in system configured for direct printing operations, the ink receiver may comprise the print medium, such as paper, transparency, etc. In addition, although the intermediate imaging member is shown as a drum in FIG. 3, the intermediate member may comprise a belt or any other suitable device for receiving ink from the print head assembly and subsequently transferring the ink to the recording media.

The various machine functions are regulated by a system controller 100 implemented in the electronics module 44. The controller 100 is preferably a programmable controller, such as a microprocessor, which controls all of the machine functions hereinbefore described. The controller also generates control signals that are delivered to the components and subsystems through the interface components. These control signals, for example, drive the piezoelectric elements to expel ink from the ink jet arrays in the print head assembly 50 to form an image on the imaging member 52 as the member rotates past the print head.

The system controller 100 may be configured to determine the image density of an image to be printed. The image density may be determined, detected and/or identified using any suitable method. For example, in one embodiment, the system controller may include a pixel counter 84 for counting the number of pixels to be imaged with ink on each sheet or page of the job, for each color.

A memory 88 may be provided to store data necessary for the controller such as, for example, pixel count information, component control protocol, etc. The memory 88 may be a non-volatile memory such as a read only memory (ROM) or a programmable non-volatile memory such as an EEPROM or flash memory. Of course, as mentioned above, memory 88 may be incorporated into the electronics module, or may be externally located.

During operations, the controller 100 receives print data from an image data source (not shown). The image data source can be any one of a number of different sources, such as a scanner, a digital copier, a facsimile device that is suitable for generating electronic image data, or a device suitable for storing and/or transmitting electronic image data, such as a client or server of a network, or the Internet. For example, the image data source may be a scanner, or a data carrier such as a magnetic storage disk, CD-ROM or the like, or a host computer, that contains scanned image data.

The print data may include various components, such as control data and image data. The control data includes instructions that direct the controller to perform various tasks that are required to print an image, such as paper feed, carriage return, print head positioning, or the like. The image data is the data that instructs the print head to mark the pixels of an image, for example, to eject one drop from an ink jet print head onto an image recording medium. The print data received from the image data source can include both control data and image data and can be compressed and/or encrypted in various formats.

Accordingly, the controller 100 can separate the print data into the control data and the image print data, respectively. Once the image data is separated, the pixel counter 84 may count the number of active pixels in the image data. To accomplish this, the pixel counter 84 may divide the image data into rows of pixels, and then further divides each row into columns. By dividing the image data into rows and columns, the number of active pixels in a specific portion of the image data can be determined. Additionally, determining the number of active pixels in the image data enables a determination image density, or solid area coverage (SAC) value for that particular image. In one embodiment, the SAC corresponds to a ratio of the number of active pixels in the image data relative to the total number of pixels that are available to be activated. The SAC value may be stored in the memory and accessed by the controller 100 (explained in more detail below).

The print head assembly 50 may include a print head for each composite color. For example, a color printer may have one print head for emitting black ink, another print head for emitting yellow ink, another print head for emitting cyan ink, and another print head for emitting magenta ink. In this embodiment, ink sticks 30 of each color are delivered through separate feed channels to a melt plate. Consequently, each channel may have a melt plate, ink reservoir, and print head that is independent from the corresponding components for the other colors. Thus, each print head of the print head assembly may include a reservoir for holding ink for that print head. Other print head assembly configurations, however, are contemplated. For instance, the print head assembly may comprise one printhead that receives ink from a plurality of on-board ink reservoirs. In another embodiment, a single reservoir may supply ink to a plurality of print heads.

Figure 4:
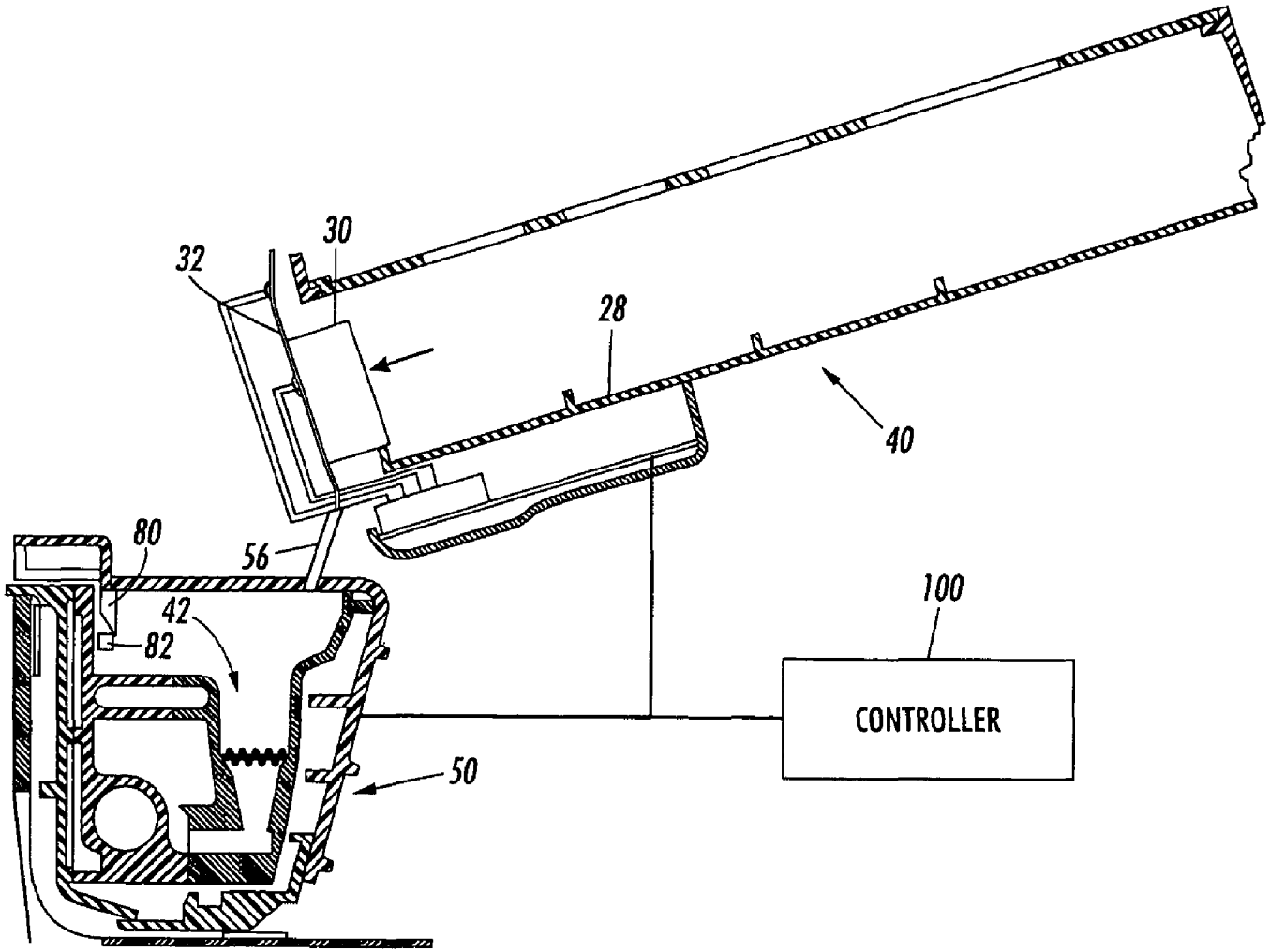
FIG. 4 is a schematic view of an ink loading assembly and print head assembly of the imaging device of FIG. 1.

Referring now to FIG. 4, print head assembly 50 may include at least one reservoir 42 for receiving melted ink from the ink melter 32 and for communicating the melted ink through nozzles (not shown) within the print head assembly 50 for printing on a document. In one embodiment, the reservoir 42 is configured to hold approximately 5 to 6 grams of melted ink although the reservoir may be configured to hold any suitable amount of ink. The ink reservoirs 42 may contain a single ink color, e.g., cyan, magenta, yellow or black, or they may be compartmentalized to contain more than one ink color. The reservoir 42 may also include a heating element (not shown) for maintaining the ink stored therein in liquid form.

The reservoir 42 may also include a level sensor for detecting an amount of ink in the reservoir. In one embodiment, the sensor comprises a conductivity probe 80 that extends downwardly into the reservoir 42. The distal portion 82 of each probe 80 is positioned at approximately the 3 gram level in each reservoir 42. The probe 80 forms a portion of an electrical circuit (not shown). If ink is in contact with the probe 80, the circuit corresponding to that reservoir provides a low voltage signal corresponding to a closed loop condition. If ink is not in contact with the probe 80, the circuit provides a high voltage signal corresponding to an open loop condition. Accordingly, in a printing operation, as ink is supplied from the reservoir 42 to the print head 50, the ink volume will continue to flow out until the level detector 80 indicates an open circuit, at which point the controller 20 will consider that the remaining usable volume of ink in each reservoir in the system is approximately 3 grams. Upon refilling, with melted ink supplied from the ink melter 32, the sensor 80 will not function as part of a closed circuit until ink volume has risen again to contact the sensor 80, i.e., approximately 5 to 6 grams.

As mentioned above, due to various factors, such as high image density print jobs, melted ink in the print head reservoir 42 may be communicated from the reservoir 42 to a print head 50 faster than it can be replenished thereby uncovering the ink level sensor 80 and causing the level sensor 80 to indicate an open loop condition for the reservoir. In prior art systems, when a reservoir level sensor 80 indicated an open loop condition (ink level falling below "full" level of reservoir), printing was typically paused or stopped until the ink was replenished and the level sensor was covered, or, e.g., indicated a closed loop condition. Pausing or stopping printing operations to replenish the reservoir is undesirable for a number of reasons. For instance, sudden stopping may cause a printer user to think that there is a fault with the machine; the system may not make efficient use of the ink in the reservoir that is below the level sensor; and the system may start and stop continually while printing high area coverage jobs.

As an alternative to pausing or stopping printing operations as soon as an open loop condition is detected, the present system is configured to estimate ink volume in a print head reservoir once an open loop condition has been indicated for that reservoir and adjusting a print speed of the system in order to decrease an extraction rate of ink from the reservoir to the print head without pausing or stopping imaging operations.

Thus, in one embodiment, the controller is configured to continually estimate the volume of ink for each reservoir in the print head assembly once a reservoir sensor indicates that the reservoir is open loop. The estimate of the amount of ink in each reservoir may be maintained in the system memory. The estimates are advantageously stored in a non-volatile memory so the estimates are maintained even when power to the printer is cycled or unintentionally disconnected.

As described above, the level sensor in the reservoir may be positioned at approximately the 6 gram level in the reservoir. Accordingly, in a printing operation, as ink is supplied from the reservoir 42 to the print head 50, the ink volume continues to flow out until the level detector 80 indicates an open loop condition, at which point the controller 100 sets the remaining usable volume of ink in the reservoir to approximately 3 grams in memory.

Thereafter, the controller may monitor the approximate amounts of ink flowing into and out of the reservoir to update the estimated volume data stored in memory. For instance, the controller may determine an amount of ink ejected from the print head during an ink consumption event by keeping track of the number of drops ejected during the event. Information regarding the size of each drop for the particular printhead may be stored in the memory 88. An ink volume or mass of ink printed for the consumption event is then determined by the product of the number of drops printed and the drop weight or drop volume for the printhead 50. This amount may then be subtracted from the estimate in memory for the corresponding reservoir to determine the amount of ink remaining in the reservoir after the printing operation. The rate that melted ink is delivered from the ink melter 32 to the reservoir 42 is typically known and may be stored in memory. The mass of ink that flows into the reservoir is the product of the extraction rate of the ink from the melter and the time that that power is supplied to the heater to melt the ink. This amount may be added to the estimate in memory for the corresponding reservoir 42.

Thus, in one embodiment, the controller is configured to continually estimate the ink volume in the reservoir while in an open loop state until the reservoir sensor signals a closed loop state indicating that the ink level has returned to the nominal usage level in the reservoir. The continual estimate of the ink volume in each reservoir enables the reservoir to continue to be used after the open loop condition occurs. Therefore, printing operations need not be stopped at the first indication of an open loop condition. In another embodiment, a threshold value may be set and stored in memory that corresponds to an ink volume that is between full and empty. Printing operations may then continue normally until the ink volume has reached the threshold value, at which point, the controller may pause operations until the reservoir has been replenished.

As an alternative to stopping or pausing printing operations once the threshold value is reached, the controller may be configured to decrease the printing speed of the system. The print speed may be advantageously selected so that the ink flowing to a print head from the reservoir is less than the rate at which ink flows into the reservoir from the ink melting assembly. Once the reservoir returns to closed loop the controller may return the system to full speed. Of course, this logic may be applied to each reservoir in the print head assembly. Decreasing the print speed has the benefit of increasing the ratio of ink flowing into the reservoir from the ink melter relative to the ink flowing out of the reservoir to the print head during imaging operations. Imaging operations do not have to be stopped immediately to allow the reservoirs to be replenished, and more efficient use of the ink in the reservoirs is facilitated.

In one embodiment, the print speed corresponds to the rate of motion of the printhead relative to the intermediate image member (in the case of indirect printing) or to a print medium (in the case of direct printing). In this embodiment, the print head assembly includes a motor (not shown) for controlling the motion of the print head assembly relative to an ink receiver. The print head motor may be provided with a rotation detection sensor, such as a rotary encoder, and the output from this sensor may be communicated to the controller 100. The controller may be configured to recognize the actual speed of print head motor and increase or decrease the control voltage outputted to motor, so that the movement of the print head assembly 50 is performed at the selected print speed. Thus, in operation, when an open loop condition is detected for a reservoir, the controller may decrease the print speed by decreasing the rate of movement of the print head assembly relative to the ink receiver thereby decreasing the rate of ink being ejected from the print heads.

In another embodiment, the print speed may correspond to the throughput, or page-per-minute (PPM) rate, of the printer. One technique for being able to operate the device at various throughput rates is to maintain a running count of images generated by the device 10 and skipping an image cycle at predetermined intervals. For instance, to switch from 50 ppm to 40 ppm, every fifth image cycle may be skipped. In this way, the machine simply skips every fifth image producing opportunity, slowing the effective speed of the machine from 50 ppm to 40 ppm. Any suitable technique may be employed for slowing the print speed of the device. For example, in addition to the print head motor, the other motors which physically operate the device may be slowed, such as, for example, the motors for controlling the feed rate of a recording medium, and/or the motor that controls the rotation of the intermediate transfer member 58. In another embodiment, the rate of input of image data from controller 100 to the print head assembly may be altered. With regard to the software in controller 100, these various possible slow down techniques can be readily incorporated by the use of control software, so that these slow down features can be readily activated or deactivated by selectably branching to different routines.

The print speed implemented during an open loop condition may be predetermined and preprogrammed into the memory so that it is accessible by the controller 100. The print speed implemented during an open loop condition may correspond to the image density of a print job. As mentioned above, the controller maintains an image density, or SAC value, in memory for each print job to be printed. Thus, if the estimated ink level in a reservoir reaches the threshold level, the controller may slow down the system to an appropriate rate corresponding to the SAC value for the image to be printed. In one embodiment, the controller may use the current SAC value as a lookup value for accessing data stored in memory. The stored data may be stored in a data structure, such as for example, a table. The table may comprise a plurality of SAC values with associated PPM rates and control information pertaining to the PPM rates. The controller, armed with the SAC value, may then determine the PPM rate at which to run the system.

Figure 5:
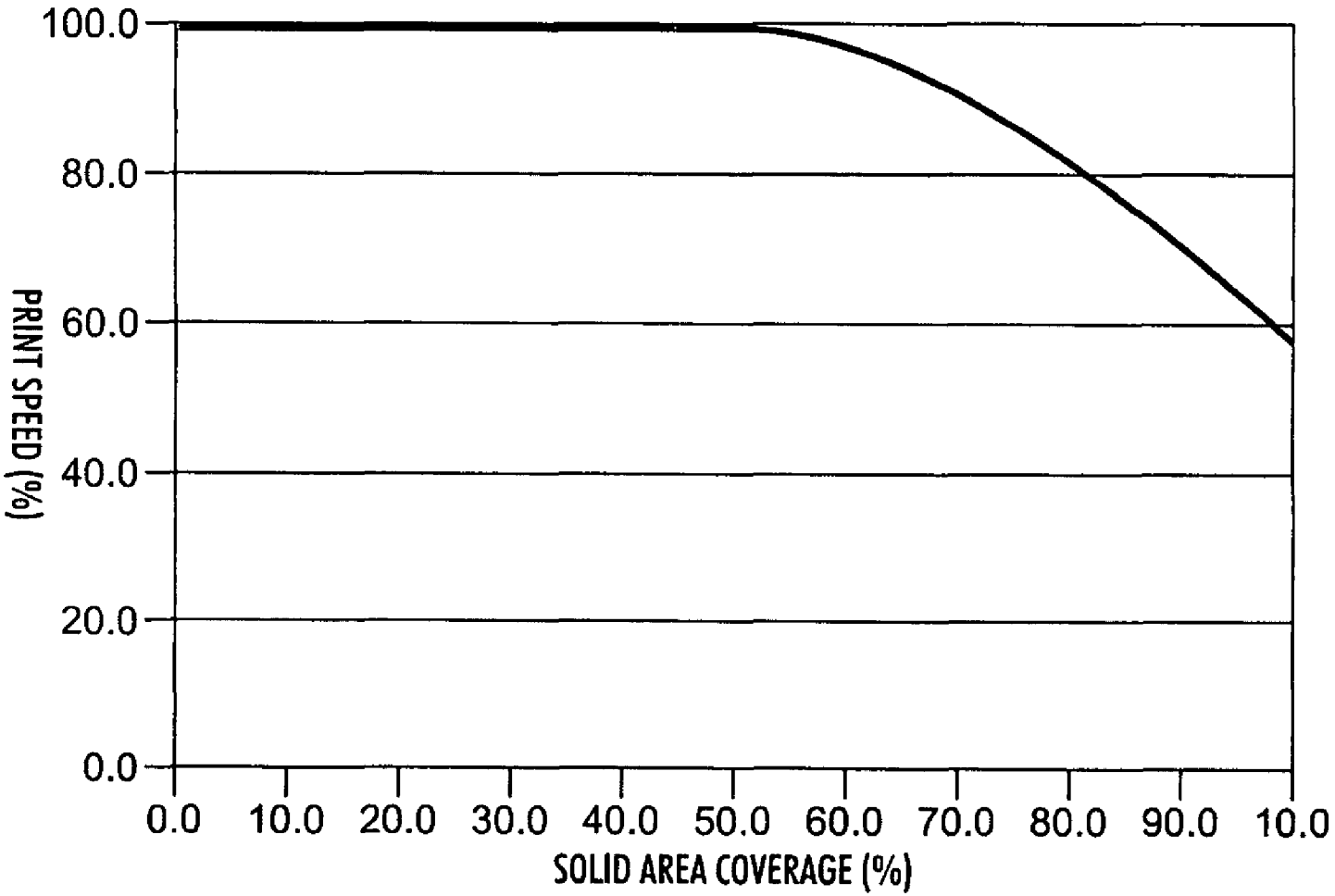
FIG. 5 is a graph of one embodiment of a method for selecting a target speed (throughput) based on the solid area coverage (SAC).

In one embodiment, the open loop print speed implemented may be a function of the image density of the print job. For example, referring to the graph in FIG. 5, if the image density, or SAC value, indicates that the area coverage for the current image is 90%, the controller may decrease the print speed of the system by 30%. Similarly, if the SAC is 60%, the controller may decrease the print speed by 10%. Once the reservoir returns to closed loop, the controller may return the system to full speed, or the default speed.

The present system may be configured to control the transitions between the selected print speeds. For instance, the transition from full speed, or closed loop speed, to the reduced speed, or open loop speed, should be fast enough to ensure that the ink level in a reservoir does not get too low. The transition from the open loop speed to the closed loop speed, however, may be damped in order to prevent high frequency oscillations between full speed and the reduced speeds that may occur when print jobs alternate between high coverage and low coverage jobs. Thus, in one embodiment, the transition from open loop to closed loop speed may be a function of a rolling average of the SAC value. For instance, as mentioned above, the controller maintains an SAC value for each current print job. The controller may be configured to determine a rolling SAC average by taking the average of the current SAC value with the preceding SAC value. The rolling SAC average may be stored in memory. The rolling SAC average may be used by the controller as a damping constant to ensure a more graceful speed up from open loop speed to closed loop speed. Therefore, if the system becomes closed loop but the rolling SAC average is still high (high area coverage), and, therefore, likely to go open loop again, the system speed may be increased more slowly. Similarly, if the system becomes closed loop and the rolling SAC average is low (low area coverage), and, therefore, unlikely to go open loop again, the system speed may be increased more rapidly.

Figure 6:
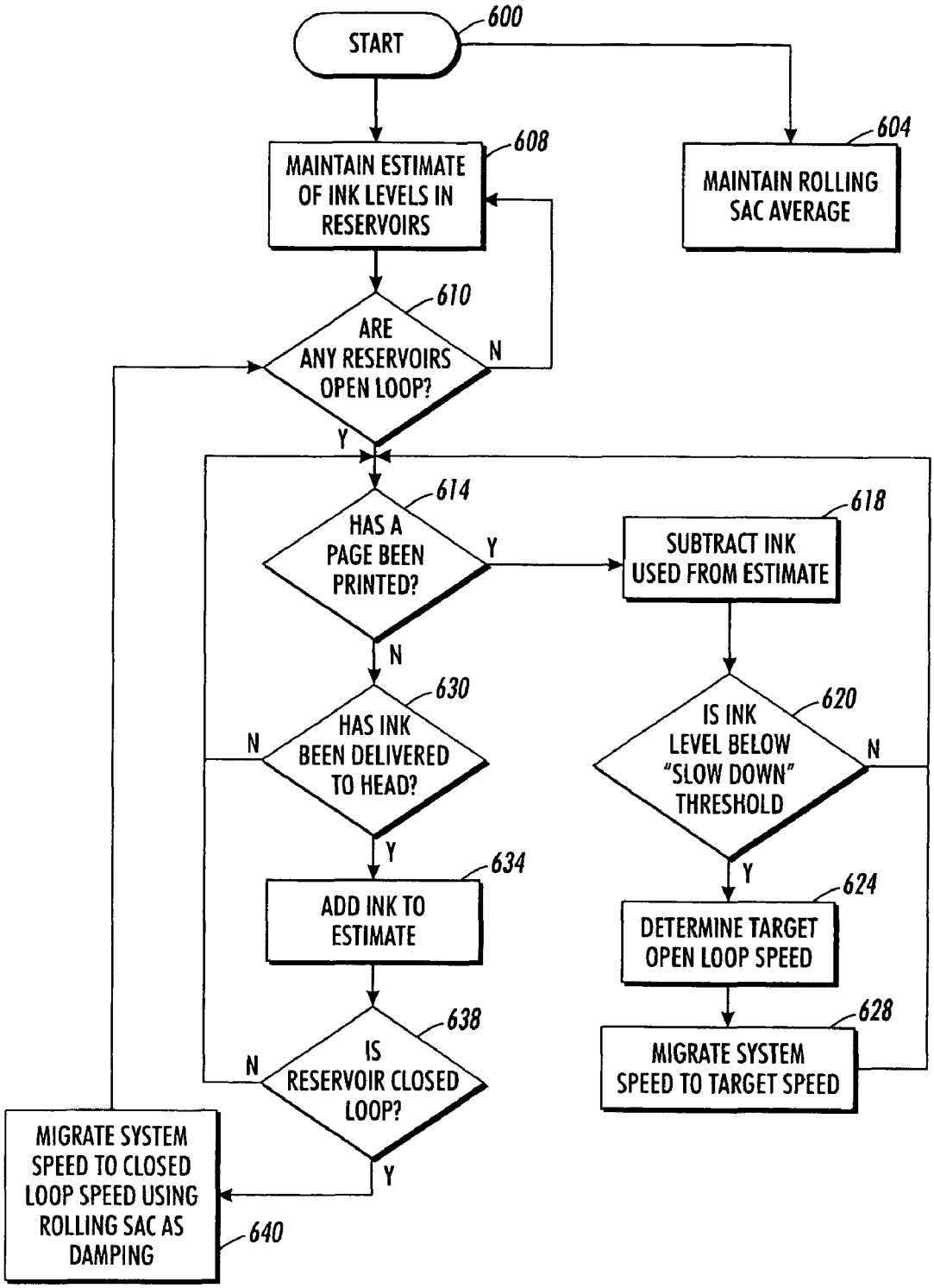
FIG. 6 is a flowchart of an embodiment of a method for controlling the print speed of the phase change imaging device of FIG. 1.

FIG. 6 is a flowchart of an embodiment of a method for open loop print speed control that may be implemented in an imaging device. It is emphasized that the present method may be utilized with other imaging apparatus and technologies that differ from the preferred embodiment now presented. For example, while the present method is described in conjunction with a phase change ink imaging device, the present method may also be practiced with other forms of ink jet printing devices.

In this embodiment, the controller maintains a rolling SAC average of the print jobs (block 604). The rolling SAC average may be determined by counting the active pixels in the image data of print jobs to be performed and averaging the current SAC value with the next successive SAC value. At the same time, the controller maintains an estimate of the volume of ink that is available in each reservoir (block 608). When the system is closed loop, the estimate corresponds to a "full" level for each reservoir.

The controller monitors ink level sensors for each reservoir to determine if any of the reservoirs becomes open loop (block 610). Once a reservoir becomes open loop, the estimate for the volume of ink in the reservoir is set to a value corresponding to the volume that may be in the reservoir at which the melted ink loses contact with the level sensor.

The controller then determines if a page has been printed (block 614). If a page has been printed, the estimate of the ink volume in the open loop reservoir is updated by subtracting the ink used to print the page (block 618). A comparison is then made between the updated estimate and a "slow down" threshold volume level (block 620). The "slow down" threshold value is a predetermined value selected to correspond to a volume at which the system speed may need to be decreased in order to allow the ink reservoir to be replenished. If the updated volume estimate is greater than a "slow down" threshold value, then control returns to block 614. If the updated estimate value is less than the "slow down" threshold value, the controller uses the rolling SAC value to determine a target open loop speed at which to run the system (block 624). The controller then migrates the system speed to the target speed (block 628).

If a page has not been printed, a determination is made whether melted ink has been delivered to the reservoir from the melter (block 630). If ink has been added to the reservoir, the estimate for the volume of the ink in the reservoir is updated with the added amount of ink (block 634). A determination is then made whether the added ink in the reservoir has returned the reservoir to closed loop status (block 638). If the reservoir has not returned to closed loop status, control is returned to block 614 to determine if a page has been printed. If the reservoir has returned to closed loop status, the controller migrates the system speed to full speed, or closed loop speed, while damping the transition from open loop speed to closed loop speed with a damping constant that corresponds to the rolling SAC average (block 640).

The controller may be adapted to perform the method of FIG. 6 in response to computer-readable instructions. These computer-readable instructions may be in the form of software, firmware or hardware. In a hardware solution, the instructions may be hard coded as part of a processor, e.g., an application-specific integrated circuit (ASIC) chip. In a software or firmware solution, the instructions may be stored in memory.

Although the embodiments above have been described in conjunction with phase change ink-jet printers, the teachings may be readily applied to other types of imaging devices such as, for example, copiers, plotters, facsimile machines, thermal ink-jet printers, etc. In addition, the illustrated embodiments may be incorporated in systems that utilize marking materials other than the phase change inks described above, such as, for example, aqueous inks, oil based inks, etc.

Those skilled in the art will recognize that numerous modifications can be made to the specific implementations of the melting chamber described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for controlling print speed of a phase change ink imaging device, the system comprising:

a level sensor configured to generate a first signal indicating an open loop state in response to an ink volume in a print head reservoir being below a setpoint level and a second signal indicating a closed loop state in response to the ink volume being at or above the setpoint level;

a pixel counter configured to measure an image density for at least a portion of a print job; and a controller in communication with the level sensor and the pixel counter, the controller being configured:

to adjust print speed of the phase change ink imaging device from a first speed to a second speed in response to the first signal indicating an open loop state, the second speed corresponding to the image density and both the first speed and the second speed being greater than zero;

to adjust the print speed to the first speed in response to the second signal indicating a closed loop state; and to damp transitions from the second speed to the first speed with reference to a rolling solid area coverage (SAC) average.

2. The system of claim 1, further comprising a memory; and the controller being further configured to generate an estimate of a volume of liquid ink in the print head reservoir and store the estimate in the memory after the first signal is generated.

3. The system of claim 2, the controller being further configured to set the estimate of the volume of ink in the print head reservoir to a volume corresponding to the setpoint level in response to the first signal being generated.

4. The system of claim 2, the controller further comprising a comparator configured to compare the estimate of the volume of liquid ink in the print head reservoir to a threshold value in response to the first signal being generated; and the controller is further configured to adjust the print speed of the phase change ink imaging device to a second speed if the estimate is below the threshold value.

5. The system of claim 3 the controller being further configured to select the second speed from a plurality of speeds, each of which corresponds to a different image density value.

6. The system of claim 1 wherein the second speed is less than the first speed.

7. The system of claim 1 wherein the print speed corresponds to a rate of motion of a print head relative to an intermediate image member.

8. The system of claim 1 wherein the print speed corresponds to a rate of motion of a print head to a print medium.

9. The system of claim 1 wherein the print speed corresponds to a throughput rate for the phase change ink imaging device.

10. The system of claim 9, the controller being further configured to skip an image cycle at predetermined intervals.

* * * * *